United States Patent [19]

Melzer et al.

[11] 4,155,764

[45] May 22, 1979

[54] PHOTOGRAPHIC COLOR DEVELOPER COMPOSITION

[75] Inventors: Arnfried Melzer, Cologne; Erwin Schön, Leverkusen, both of Fed. Rep. of Germany

[73] Assignee: AGFA-Gevaert, A.G., Leverkusen, Fed. Rep. of Germany

[21] Appl. No.: 797,811

[22] Filed: May 17, 1977

[30] Foreign Application Priority Data

May 21, 1976 [DE] Fed. Rep. of Germany ..... 2622950

[51] Int. Cl.[2] ..... G03C 5/30

[52] U.S. Cl. ..... 96/66.4; 96/56; 96/59

[58] Field of Search ..... 96/66 R, 66.4, 56

[56] References Cited

U.S. PATENT DOCUMENTS

| | | | |
|---|---|---|---|
| 2,936,308 | 5/1960 | Hodge | 96/66.4 |
| 3,068,100 | 12/1962 | Dersch | 96/66.4 |
| 3,582,333 | 6/1971 | Yost et al. | 96/56 |
| 3,664,835 | 5/1972 | Youngquist | 96/66 R |
| 3,700,442 | 10/1972 | Gabrielson et al. | 96/66.4 |
| 3,846,129 | 11/1974 | Kuh | 96/66 R |

FOREIGN PATENT DOCUMENTS

| | | | |
|---|---|---|---|
| 9537 of | 1906 | United Kingdom | 96/66.4 |

*Primary Examiner*—Mary F. Kelley

[57] ABSTRACT

A photographic color developer composition containing a color developer compound and an antioxidant wherein it contains a water-soluble enolizable α-aminocarbonyl compound as antioxidant is provided. Resistance to atmospheric oxygen of photographic color developer baths is improved.

3 Claims, No Drawings

PHOTOGRAPHIC COLOR DEVELOPER COMPOSITION

This invention relates to an aqueous alkaline colour developer composition containing novel antioxidants.

Hydroxylamine is one of the most common antioxidants in practice. It is known that hydroxylamine decomposes slowly under the influence of atmospheric oxygen and that this decomposition can be accelerated by certain other standard additives, for example heavy metal ions. Additives such as these greatly impair the stability of colour developer baths containing hydroxylamine. It has also been found that hydroxylamine not only acts as an antioxidant, but also apparently influences the results of development under certain conditions. For example, it has been found in reversal processing that the colour densities obtained during reversal development depend from the concentration of hydroxylamine.

It is obvious that, where the developer baths are used over fairly long periods, this does not lead to reproducible results, particularly when processing is carried out at elevated temperatures, especially since the concentration of the hydroxylamine can change quickly as a result of decomposition.

U.S. Pat. No. 3,615,503 describes the use of certain α-hydroxy keto compounds as antioxidants for colour developer compositions which are said to be superior to hydroxylamine in preventing oxidation. Although a certain improvement in the stability of the colour developer compositions is obtained with some of these α-hydroxy keto compounds, there is still a need to find other antioxidants with which the stability of colour developer compositions can be further improved.

The object of the present invention is to provide new antioxidants for aqueous alkaline colour developer compositions which show a reduced tendency towards decomposition or which influence the results of development to a lesser extent than hydroxylamine and which are superior to conventional antioxidants in their antioxidation effect.

The present invention provides a colour developer composition which contains a colour developer compound and an antioxidant, distinguished by the fact that it contains an enolisable α-aminocarbonyl compound as the antioxidant. The antioxidants according to the invention contain groups capable of tautomerism as follows:

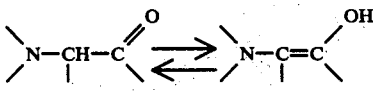

Accordingly, in the carbonyl form they contain, on the carbon atom between the nitrogen atom and the carbonyl group a hydrogen atom which can be shifted to the carbonyl oxygen atom and which may optionally be removed by dissociation in an alkaline medium. The type and size of the other substituents is not critical as long as the α-aminocarbonyl compounds remain adequately soluble. The antioxidants according to the invention correspond in particular to the following general formula:

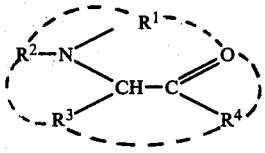

(I)

in which $R^1$, $R^2$, $R^3$ and $R^4$ are the same or different and represent hydrogen, hydrocarbon radicals including alkyl, cycloalkyl, for example cyclohexyl, or aryl, for example phenyl, which may also be further substituted, or heterocyclic groups, for example thienyl, with the proviso that the four radicals $R^1$, $R^2$, $R^3$ and $R^4$ do not simultaneously represent hydrogen.

In addition, $R^1$ and $R^2$ together may represent the radicals for completing a heterocyclic ring, for example a pyrrolidine, piperidine or morpholine ring, and/or $R^2$ and $R^3$ together may represent the radicals for completing a heterocyclic ring, for example a piperidine ring, and/or $R^3$ and $R^4$ together may represent the radicals for completing a heterocyclic or carbocyclic ring, preferably with 5, 6 or 7 ring members, more especially a carbocyclic ring, for example a cyclohexanone ring, and/or $R^4$ and $R^1$ together may represent the radicals for completing a heterocyclic ring, for example a piperidone ring.

An alkyl group represented by one of the radicals $R^1$, $R^2$, $R^3$ and $R^4$ preferably contains up to 5 carbon atoms, for example methyl, ethyl or butyl. These alkyl groups may contain further substituents, for example hydroxyl groups, amino groups or phenyl groups. Examples of particularly suitable substituted alkyl radicals are polyhydroxy alkyl radicals of the type present, for example, in sugar molecules.

Antioxidants suitable for the purposes of the present invention correspond for example to the following general formula:

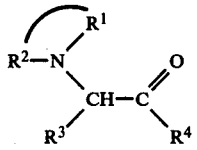

(II)

in which $R^1$ and $R^2$ together represent the radicals for completing a heterocyclic ring, for example a piperidine, pyrrolidine or morpholine ring; and $R^3$ and $R^4$ are the same or different and represent hydrogen, alkyl, for example methyl, ethyl or butyl, including substituted alkyl radicals, aryl, for example phenyl, or heterocyclic groups.

According to the invention, other suitable antioxidants correspond, for example, to the following general formula:

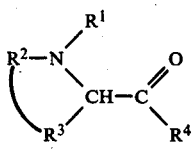

(III)

in which $R^1$ and $R^4$ are the same or different and represent hydrogen, alkyl, for example methyl, ethyl or butyl, including substituted alkyl radicals, aryl, for example phenyl, or heterocyclic groups; and $R^2$ and $R^3$ together represent the radicals for completing a heterocyclic ring, for example a piperidine ring. Other antioxidants suitable for the purpose of the invention correspond, for example, to the following general formula:

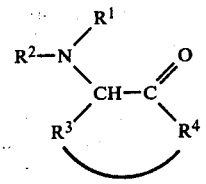

(IV)

in which $R^1$ and $R^2$ are the same or different and represent hydrogen, alkyl, for example methyl, ethyl or butyl, including substituted alkyl radicals, aryl, for example phenyl, or heterocyclic groups; and $R^3$ and $R^4$ together represent the radicals for completing a heterocyclic or carbocyclic ring, more especially a carbocyclic ring, for example a cyclohexanone ring.

According to the invention, other suitable antioxidants correspond, for example, to the following general formula:

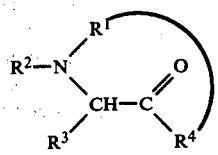

(V)

in which $R^1$ and $R^4$ together represent the radicals for completing a heterocyclic ring, for example a piperidone ring; and $R^2$ and $R^3$ are the same or different and represent hydrogen, alkyl, for example methyl, ethyl or butyl, including substituted alkyl radicals, aryl, for example phenyl, or heterocyclic groups.

Compounds of general formula (I), in which $R^3$ or $R^4$ represents a polyhydroxy alkyl radical of the type present, for example, in sugar molecules have proved to be particularly suitable. Particularly useful compounds of this type are, for example, D-glucosamine (compound 1) and 1-deoxy-1-piperidino-D-fructose (compound 2). Compounds such as these may also be present or used in the form of cyclic semiacetals either in the α-form or in the β-form.

The antioxidants according to the invention may also be added to the alkaline colour developer composition in the form of ammonium salts with an anion of any type, preferably chloride or sulphate.

It is immaterial whether, before addition, the antioxidants are present in the carbonyl form, in the enol form or in a mixture of both forms.

Examples of suitable antioxidants according to the invention are given below:

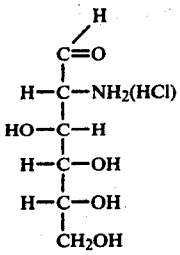

Compound 1

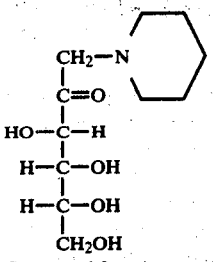

Compound 2

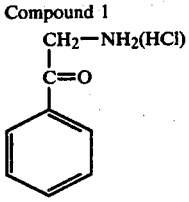

Compound 3

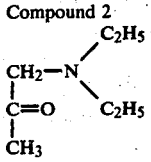

Compound 4

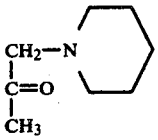

Compound 5

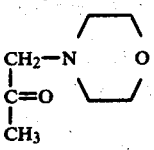

Compound 6

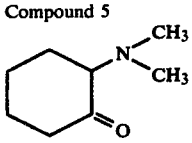

Compound 7

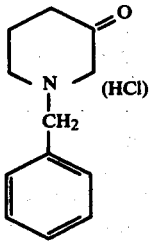

Compound 8

Compounds 1 to 8 are known compounds, some of which are commercially available.

The compounds of formula (I) considerably improve the resistance to atmospheric oxygen of photographic colour developer baths. In this respect, the compounds are superior in particular to hydroxylamine and to the compounds known from U.S. Pat. No. 3,615,503. The colour developer baths according to the invention contain the antioxidants according to the invention in quantities of generally from 0.1 to 20 g per liter and preferably in quantities of from 0.5 to 15 g per liter.

The colour developers present in the colour developer compositions according to the invention are, in particular, those of the p-phenylene diamine series with a primary amino group, for example 4-amino-N,N-dimethyl aniline, 4-amino-N,N-diethyl aniline, 4-amino-3-methyl-N,N-diethyl aniline, 4-amino-3-methyl-N-methyl-N-(β-methylsulphonamidoethyl)-aniline, 4-amino-N-ethyl-N-(β-hydroxyethyl)-aniline, 4-amino-3-methyl-N-ethyl-N-(β-hydroxyethyl)-aniline, 4-amino-3-methyl-N-ethyl-N-(β-methoxyethyl)-aniline, 4-amino-3-methyl-N-ethyl-N-(β-methylsulphonamidoethyl)-aniline or 4-amino-N-butyl-N-(ω-sulphobutyl)-aniline.

Other suitable colour developers are described, for example, in J. Amer. Chem. Soc., 73, 3100–3125 (1951). The colour developer compounds may be present in the colour developer baths in the usual concentrations, for example in concentrations of from 0.5 to 25 g per liter.

In addition, the colour developer compositions according to the invention may contain other standard additives in the usual quantities, such as substances with an alkaline effect, for example alkali metal hydroxide, alkali metal carbonate, alkali metal phosphate or alkali metal borate, also alkali metal sulphite, alkali metal sulphate, alkali metal bromide or alkali metal iodide; silver salt solvents, for example alkali metal thiosulphate or alkali metal thiocyanate and, optionally, viscosity-increasing agents, such as hydroxyalkyl cellulose or carboxyalkyl celluloses. Instead of alkali metal ions, for example sodium or potassium ions, ammonium ions may be present in the above-mentioned additives. Other standard additives are anti-lime agents, for example, alkali metal phosphate, and alkali metal or ammonium salts of polyaminopolycarboxylic acids, for example nitrilotriacetic acid, ethylene diamine tetraacetic acid or 1,3-diaminopropanol tetraacetic acid, also salts of hydroxyethyl diphosphonic acid of the type described, for example, in DT-OS No. 2,227,639 or DT-OS No. 2,246,610. In addition, the colour developer compositions may contain soluble competitive couplers, for example citrazinic acid, development accelerators, for example polyethylene oxide derivatives or, in the case of reversal colour developer compositions, fogging agents, for example boron hydride compounds or hydrazine derivatives.

The anti-oxidation effect of the antioxidants used in accordance with the invention is superior both to that of hydroxylamine and also to that of some of the compounds described in U.S. Pat. No. 3,615,503. This is reflected in the fact that, in the colour developer compositions, the concentration of colour developer compound decreases less rapidly in the presence of the compounds according to the invention than in the presence of hydroxylamine or, for example, dihydroxy acetone or dihydroxy maleic acid. It has also been found that the antioxidants according to the invention do not themselves take any significant part in the development process, as is known to occur with hydroxylamine and has occasionally been observed under certain conditions, especially in colour reversal processing. In reversal colour development with colour developer baths containing hydroxylamine as antioxidant, fluctuations are occasionally observed in the colour density developed in dependence upon the concentration of hydroxylamine in the bath. By contrast, it is possible in cases where the antioxidants according to the invention are used, for example in cases where compound 1 is used, readily to accept fairly small fluctuations in the concentration of antioxidant without this being reflected in considerable deviations in the colour densities developed.

The antioxidants according to the invention are suitable for use in photographic colour developer baths of all kinds, for example for colour developer baths for the colour development of colour-photographic negative materials or for reversal colour developer baths for the development of colour photographic reversal materials. The advantages of the antioxidants according to the invention are particularly conspicuous in photographic colour developer baths of the type which are used at elevated temperatures and which remain in service for prolonged periods during colour photographic processing.

EXAMPLE 1

Compounds 1, 2 and 3 were used as antioxidants, in comparison with hydroxylamine sulphate and dihydroxy acetone (U.S. Pat. No. 3,615,503), in a conventional colour developer bath of the following composition ($H_2O$ to 1000 ml):

| | |
|---|---|
| Sodium hexametaphosphate | 2 g |
| Trisodium phosphate | 20 g |
| Sodium sulphite sicc. | 2 g |
| Antioxidant according to Table 1 below | 1 g |
| N,N-diethyl-p-phenylene diamine sulphate | 5 g |
| Potassium bromide | 1 g |
| pH-value (with NaOH) | 12.3 |

The developers (1 liter of each) were poured into flat dishes (150 $cm^2$ air surface) and exposed for 1 week to atmospheric oxidation. Thereafter, they were made up to exactly 1 liter with distilled water. The residual concentration of colour developer was then determined by titration with a Ce(IV) solution.

The percentage reduction in the concentration of colour developer by atmospheric oxidation is shown in Table 1.

Table 1

| Compound | Percentage reduction in concentration of colour developer |
|---|---|
| Hydroxylamine sulphate | −20 |
| Dihydroxy acetone | −17.1 |
| 1 | −15.4 |
| 2 | −15.4 |
| 3 | −15.8 |

EXAMPLE 2

The test arrangement was as described in Example 1. Compounds 1, 3, 4, 5 and 6 were compared with dihydroxy acetone; exposure time to atmospheric oxygen 2 weeks.

The results are set out in Table 2.

Table 2

| Compound | Percentage reduction in concentration of colour developer |
|---|---|
| Dihydroxy acetone | −35.8 |
| 1 | −28.3 |
| 3 | −34.6 |
| 4 | −35.0 |
| 5 | −34.4 |
| 6 | −31.6 |

EXAMPLE 3

Compound 5 was used as antioxidant in comparison with dihydroxy acetone in a colour developer bath of the following composition (per 1000 ml) for colour negative material:

| | |
|---|---|
| Sodium hexametaphosphate | 2 g |
| Sodium sulphite sicc. | 2 g |
| N,N-diethyl-p-phenylene diamine sulphate | 2.75 g |
| Antioxidant | 1.2 g |
| Potassium carbonate sicc. | 75 g |
| Potassium bromide | 2 g |

-continued

| | |
|---|---|
| pH-value | 11.1 ± 0.1 |

Testing was carried out sensitometrically with conventional colour negative film in conventional colour negative processing. A first sample was developed 24 hours after preparation of the developer bath and a second sample was developed after the developer bath had been standing for 1 week.

The difference in the $D_{max}$-values (colour coupling activity) obtained during both developments is regarded as a criterion for the anti-oxidation effect.

Table 3

| | $\Delta D_{max}$ | |
|---|---|---|
| | Dihydroxy acetone | Compound 5 |
| yellow | + 0.1 | + 0.15 |
| magenta | + 0.1 | + 0.2 |
| cyan | ± 0.0 | + 0.1 |

Positive $\Delta D_{max}$-values represent an increase in the colour coupling activity which is attributable to evaporation during the standing period and hence to a higher concentration of colour developer. In both cases, the evaporation rate during the standing period was low and uniform so that the developers were not topped up before the second development (after standing for 1 week).

EXAMPLE 4

Compounds 1 and 2 were used as antioxidants in comparison with dihydroxy acetone in a conventional colour developer of the following composition (per 1000 ml):

| | |
|---|---|
| Nitrilotriacetic acid | 2 g |
| Trisodium phosphate | 25 g |
| Sodium sulphite sicc. | 4 g |
| N,N-diethyl-p-phenylene diamine sulphate | 3.5 g |
| Antioxidant | 0.5 g |
| Potassium bromide | 0.5 g |
| Benzyl-diethyl-β-(β-cyanethoxy)-ethyl ammonium chloride | 1 g |
| pH-value | 11.8 ± 0.1 |

Testing was carried out sensitometrically with a conventional colour reversal 8 mm-film material in conventional reversal processing (8 minutes' colour development at 20° C.). For reasons of uniformity, the first development (black-and-white development) was carried out in a continuous development machine.

The first processing cycle with colour developer was carried out 24 hours after preparation, whilst the second was carried out after standing for 17 days.

The results were assessed as in Example 3.

Table 4

| | $\Delta D_{max}$—values | | |
|---|---|---|---|
| | Dihydroxy acetone | Compound 1 | Compound 2 |
| Yellow | − 0.65 | − 0.50 | − 0.20 |
| magenta | + 0.10 | + 0.10 | + 0.30 |
| cyan | + 0.05 | + 0.10 | + 0.25 |

EXAMPLE 5

Compounds 1 and 2 were compared as antioxidants with hydroxylamine sulphate and dihydroxy maleic acid (U.S. Pat. No. 3,615,503) in high-temperature colour reversal processing.

The reversal colour developer had the following

| | |
|---|---|
| composition per 1000 ml: | |
| Nitrilotriacetic acid | 5 g |
| Trisodium phosphate | 40 g |
| Sodium sulphite sicc. | 5 g |
| Antioxidant | 1.5 g |
| 4-amino-3-methyl-N-ethyl-N-(β-hydroxyethyl)-aniline sulphate monohydrate | 3.5 g |
| Potassium bromide | 1 g |
| Citrazinic acid | 1 g |
| pH-value (with NaOH) | 12.4 ± 0.1 |

Processing was carried out in the same way as in Example 4, but at a temperature of 50° C. (all baths).

A first sample of a colour reversal 8 mm-film for high temperature processing was developed 24 hours after preparation of the colour developer bath, whilst a second sample was taken after standing for 14 days, the temperature of the colour developer bath being maintained at 50° C. over, in total, about one third of the standing time. The $\Delta D_{max}$-values are shown in Table 5.

Table 5

| | $\Delta D_{max}$ | | | |
|---|---|---|---|---|
| | Hydroxylamine sulphate | Dihydroxy maleic acid | Compound 1 | Compound 2 |
| yellow | − 0.70 | − 0.80 | − 0.60 | − 0.60 |
| magenta | − 0.65 | − 0.15 | − 0.10 | − 0.10 |
| cyan | − 0.55 | + 0.05 | + 0.10 | + 0.10 |

We claim:

1. A photographic color developer composition for aqueous color development containing a developer compound of the p-phenylene diamine series and having a water-soluble enolisable α-aminocarbonyl compound for increasing the effectiveness of the developer compound and enhancing the suitability of the composition for obtaining improved color development, wherein said water-soluble enolisable α-aminocarbonyl compound has the following structural formula:

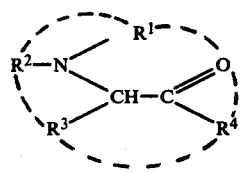

(I)

in which $R^1$ and $R^2$ are the same or different and represent hydrogen, alkyl or aryl;

$R^3$ is hydrogen or an alkyl group; and $R^4$ is hydrogen, alkyl, or aryl;

$R^1$, $R^2$, $R^3$ and $R^4$ not being simultaneously hydrogen or in which $R^1$ and $R^2$ together represent the atoms to complete a heterocyclic ring, and/or $R^2$ and $R^3$ together represent the atoms to complete a heterocyclic ring, and/or $R^3$ and $R^4$ together represent the atoms to complete a carbocyclic ring, and/or $R^4$ and $R^1$ together represent the atoms to complete a heterocyclic ring.

2. A colour developer composition as claimed in claim 1, wherein at least one of the radicals $R^3$ and $R^4$ represents a hydroxyl-substituted alkyl radical.

3. A colour developer composition as claimed in claim 1, wherein it contains D-glucosamine or 1-deoxy-1-piperidino-D-fructose as antioxidant.

* * * * *

UNITED STATES PATENT AND TRADEMARK OFFICE

CERTIFICATE OF CORRECTION

PATENT NO. : 4,155,764

DATED : May 22, 1979

INVENTOR(S) : Melzer et al.

It is certified that error appears in the above-identified patent and that said Letters Patent are hereby corrected as shown below:

Column 2, general formula 1, the broken line between $R^1$ and $R^4$ should not touch the O atom. The formula should read:

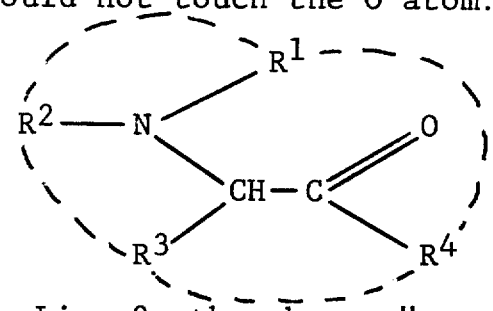

Column 8, Line 2, the phrase "composition per 1000 ml" is misplaced. It should appear as follows, above the line:

-- composition per 1000 ml: --

UNITED STATES PATENT AND TRADEMARK OFFICE

CERTIFICATE OF CORRECTION

PATENT NO. : 4,155,764

DATED : May 22, 1979

INVENTOR(S) : Melzer et al.

It is certified that error appears in the above-identified patent and that said Letters Patent are hereby corrected as shown below:

Column 8, claim 1, the broken line between $R^1$ and $R^4$ should not touch the O atom. The formula should read:

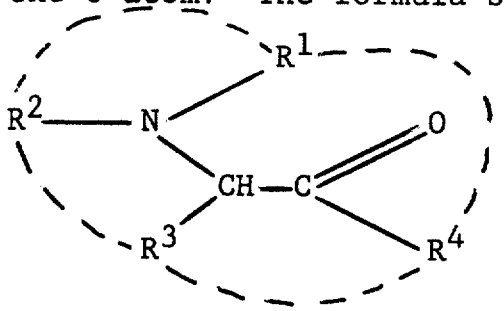

Signed and Sealed this

Sixth Day of May 1980

[SEAL]

Attest:

SIDNEY A. DIAMOND

Attesting Officer

Commissioner of Patents and Trademarks